US012274322B2

(12) United States Patent
Salazar

(10) Patent No.: US 12,274,322 B2
(45) Date of Patent: Apr. 15, 2025

(54) HOODED SWEATSHIRT SECURING DEVICE

(71) Applicant: Omar Salazar, Glendale, CA (US)

(72) Inventor: Omar Salazar, Glendale, CA (US)

( * ) Notice: Subject to any disclaimer, the term of this patent is extended or adjusted under 35 U.S.C. 154(b) by 0 days.

(21) Appl. No.: 18/233,701

(22) Filed: Aug. 14, 2023

(65) Prior Publication Data

US 2025/0057274 A1 Feb. 20, 2025

(51) Int. Cl.
*A42B 1/04* (2021.01)
*A42B 7/00* (2006.01)

(52) U.S. Cl.
CPC ..... *A42B 1/04* (2013.01); *A42B 7/00* (2013.01); *A41D 2200/20* (2013.01)

(58) Field of Classification Search
CPC ..... A41F 1/002; A44D 2203/00; Y10T 24/32; Y10T 24/3415; A44B 6/00; A44B 9/14; A44B 9/12; A44B 9/18; A42B 1/048
See application file for complete search history.

(56) References Cited

U.S. PATENT DOCUMENTS 3,135,442 A * 6/1964 Carter, Jr. ..... A41B 11/001 223/1
D641,139 S 7/2011 Shearer
10,070,674 B1 9/2018 Beckers
10,791,790 B2 10/2020 Morales
11,412,803 B2 8/2022 MacFarlane
2010/0122392 A1* 5/2010 Clark ..... A44B 9/10 2/243.1
2011/0289733 A1* 12/2011 Del Solar ..... A44B 6/00 24/3.12
2021/0204627 A1 7/2021 Linchitz
2021/0244115 A1 8/2021 Margulis
2022/0322776 A1 10/2022 Hagler

FOREIGN PATENT DOCUMENTS

ES 1103682 U * 3/2014 ..... A41F 1/002
GB 2586707 3/2021

OTHER PUBLICATIONS

Translation of ES1103682U (Year: 2014).*

* cited by examiner

*Primary Examiner* — Sally Haden
*Assistant Examiner* — Grady Alexander Nunnery

(57) ABSTRACT

A hooded sweatshirt securing device includes a plurality of bags which each has a unique engagement element with respect to each other to releasably engage a respective type of article of head wear that is worn on a user's head. A band is included which is continuous such that the band can be positioned around a headband that is worn on the user's head. A plurality of first disks is positioned within a respective one of the plurality of bags and the band. A coupler is provided that has a coupling element which is releasably matable to the first disk associated with a respective one of the plurality of bags. The coupler can be positioned on a hood of a hooded sweatshirt thereby facilitating the coupler to attach the hood to the article of headwear to which the respective receiver is attached.

6 Claims, 12 Drawing Sheets

HOODED SWEATSHIRT SECURING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to hood securing devices and more particularly pertains to a new hood securing device for attaching a hood of a hooded sweatshirt to an article of headwear. The device includes a plurality of bags which each has a unique engagement element with respect to each other for engaging an article of headwear and band that can be slipped over a headband. The device includes a plurality of first disks each integrated into a respective bag and band and which are each comprised of a magnetic material. The device includes a coupler that has a second disk which is comprised of a magnetic material for compressing a hood of a hooded sweatshirt between the second disk and the first disk associated with a respective bag or band for retaining the hood in a preferred orientation.

(2) Description of Related Art Including Information Disclosed Under 37 CFR 1.97 and 1.98

The prior art relates to hood securing devices including a variety of hooded garments that has various engagement elements integrated into a hood of the hooded garment for retaining the hood in a preferred orientation and a hook coupler that is attached to a hood of a hooded garment and which releasably engages an article of headwear. In no instance does the prior art disclose a plurality of bags that each has a unique engagement element for engaging a respective article of headwear and a coupler that is positionable on top of a hood which removably engages the bag that is attached to the article of headwear.

BRIEF SUMMARY OF THE INVENTION

An embodiment of the disclosure meets the needs presented above by generally comprising a plurality of bags which each has a unique engagement element with respect to each other to releasably engage a respective type of article of head wear that is worn on a user's head. A band is included which is continuous such that the band can be positioned around a headband that is worn on the user's head. A plurality of first disks is positioned within a respective one of the plurality of bags and the band. A coupler is provided that has a coupling element which is releasably matable to the first disk associated with a respective one of the plurality of bags. The coupler can be positioned on a hood of a hooded sweatshirt thereby facilitating the coupler to attach the hood to the article of headwear to which the respective receiver is attached.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
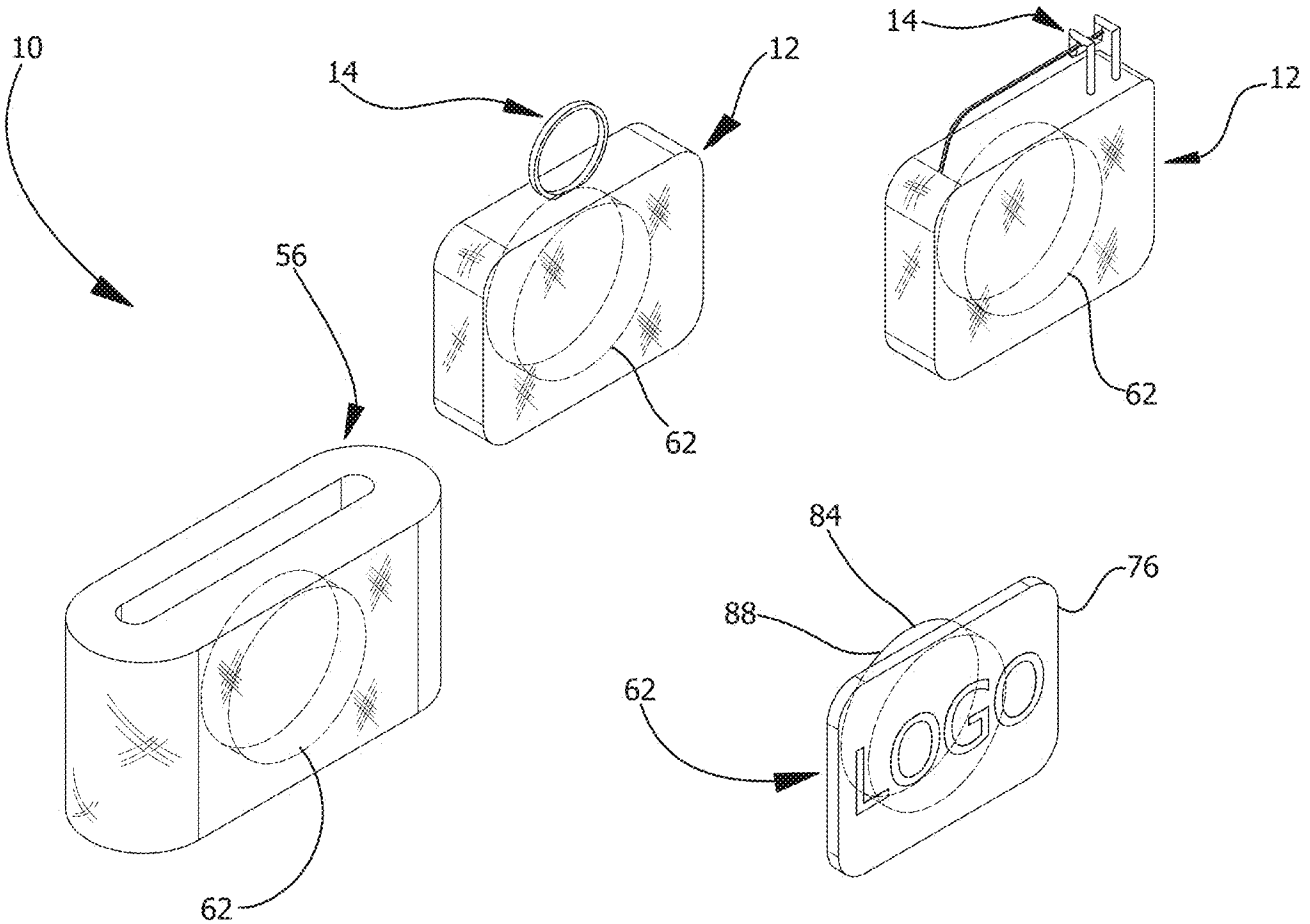
FIG. 1 is a perspective view of a hooded sweatshirt securing device according to an embodiment of the disclosure.
Figure 2:
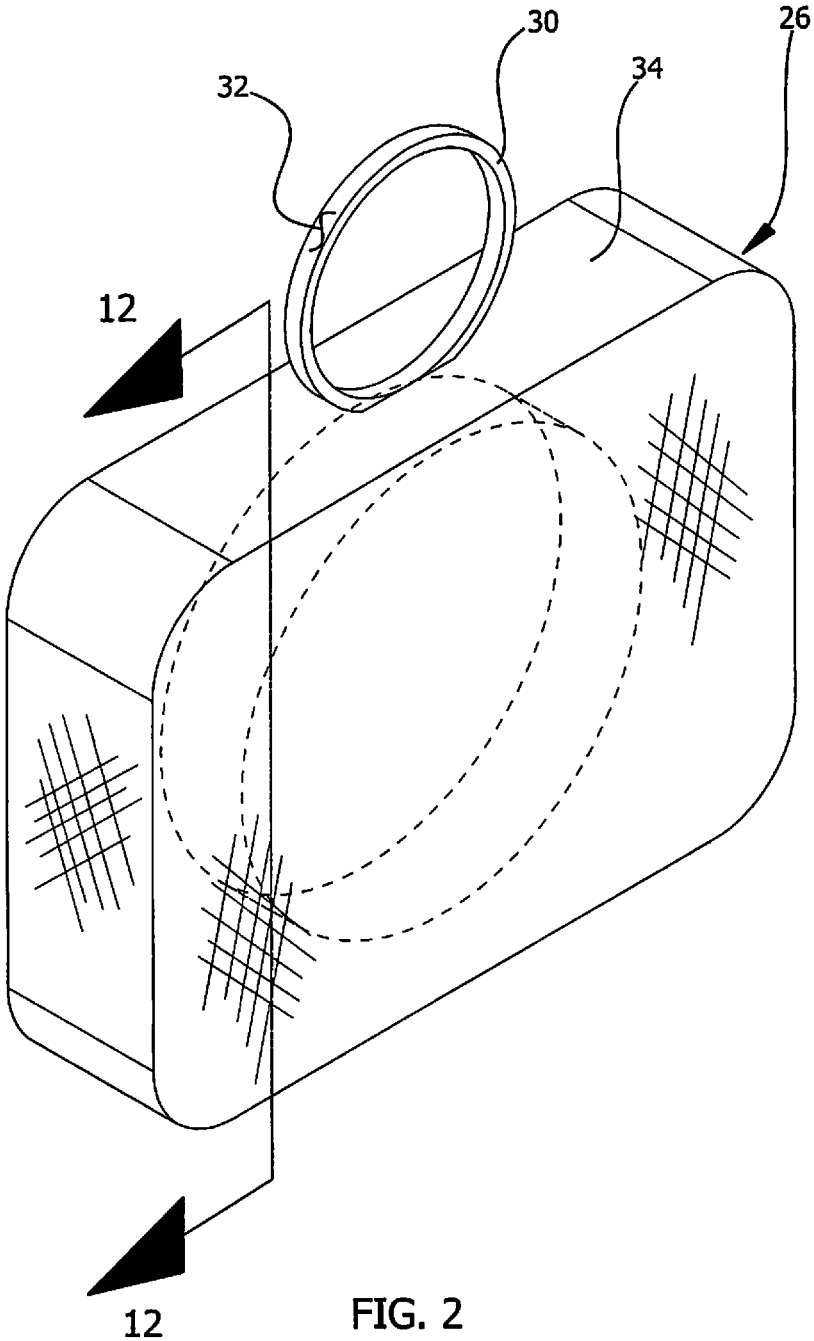
FIG. 2 is a front perspective view of hat bag of an embodiment of the disclosure.
Figure 3:
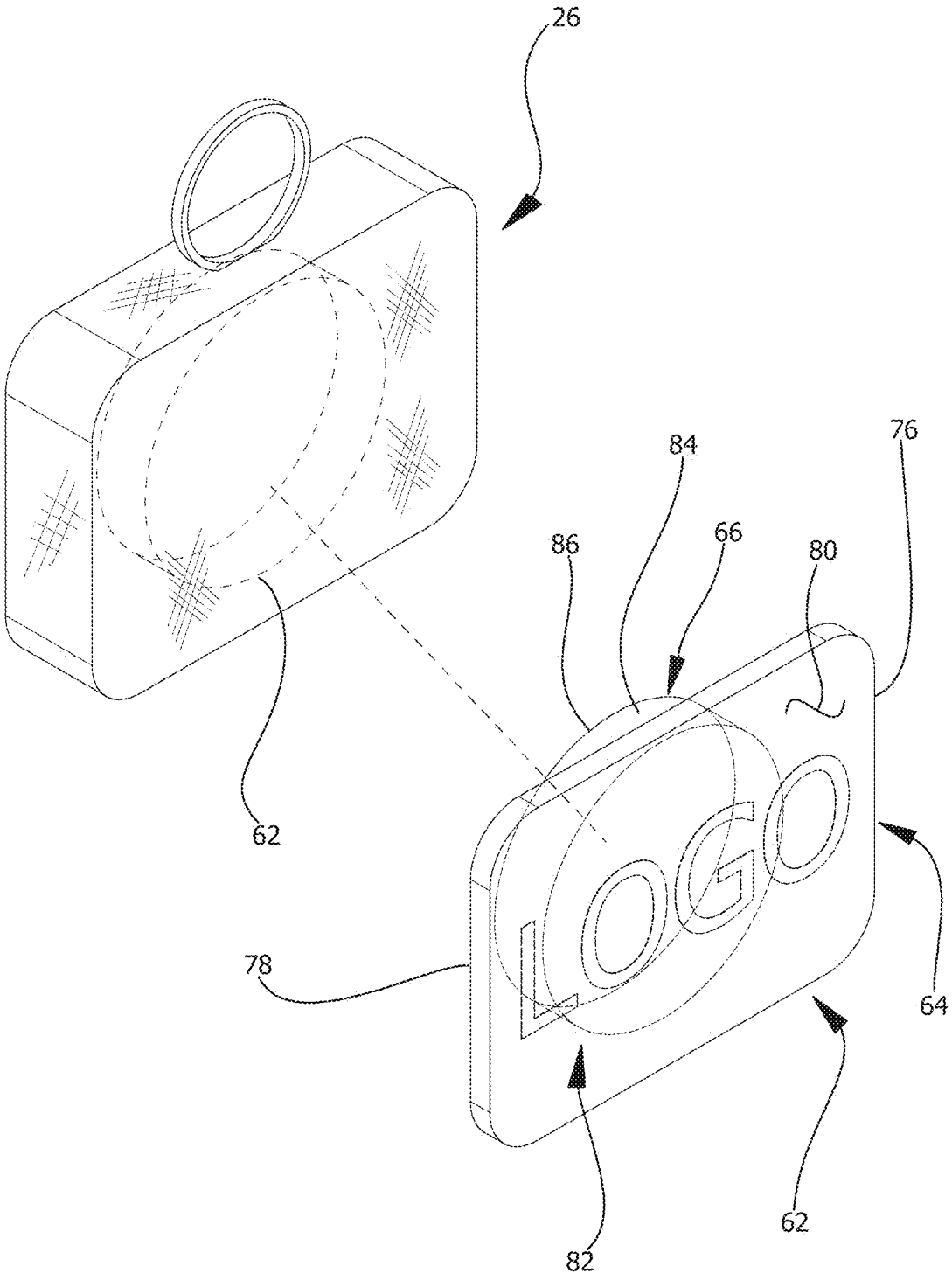
FIG. 3 is an exploded view of an embodiment of the disclosure showing a coupler being engaged to a hat bag.
Figure 4:
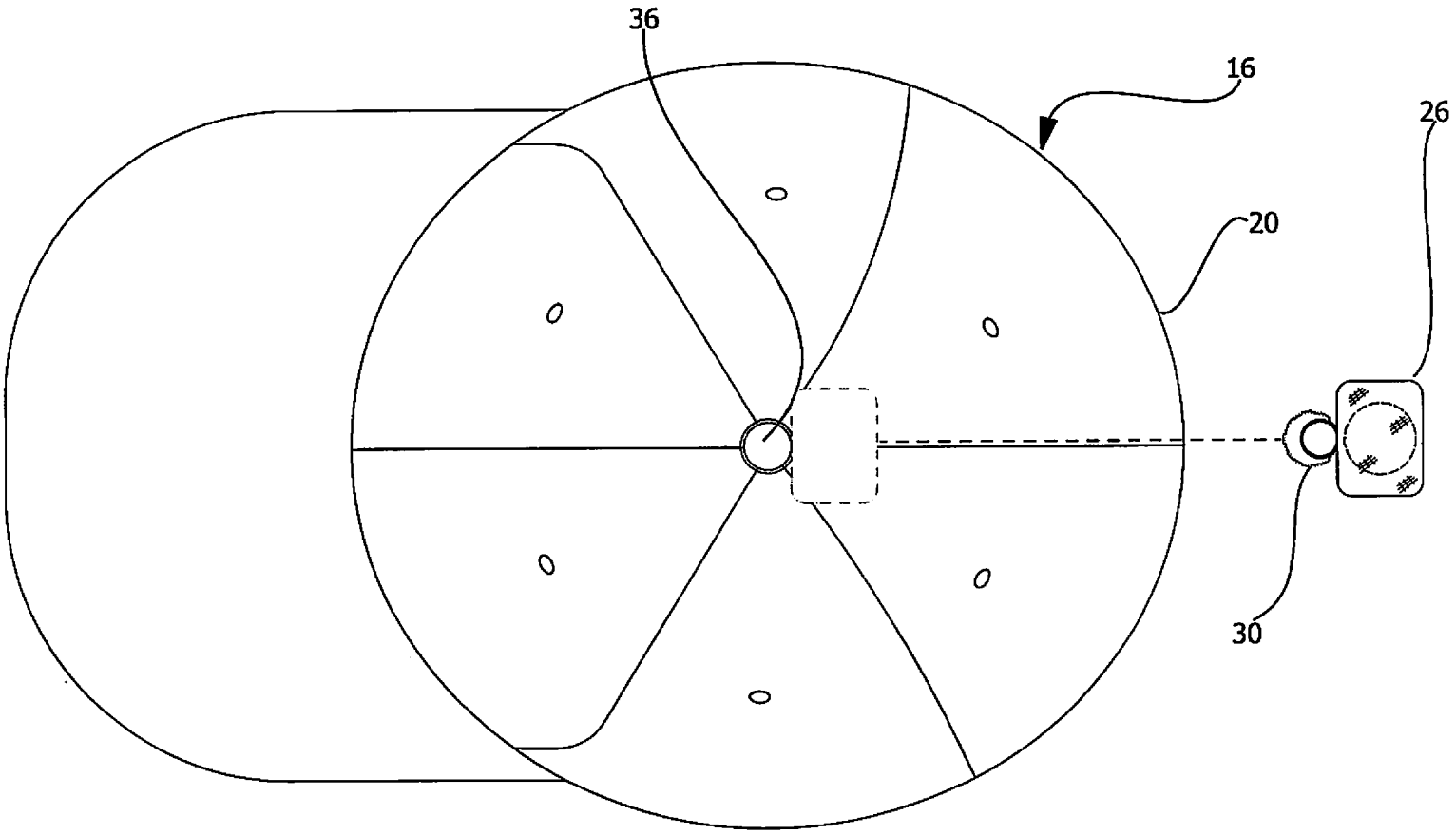
FIG. 4 is a top in-use view of an embodiment of the disclosure showing a hat bag being attached to an article of headwear.
Figure 5:
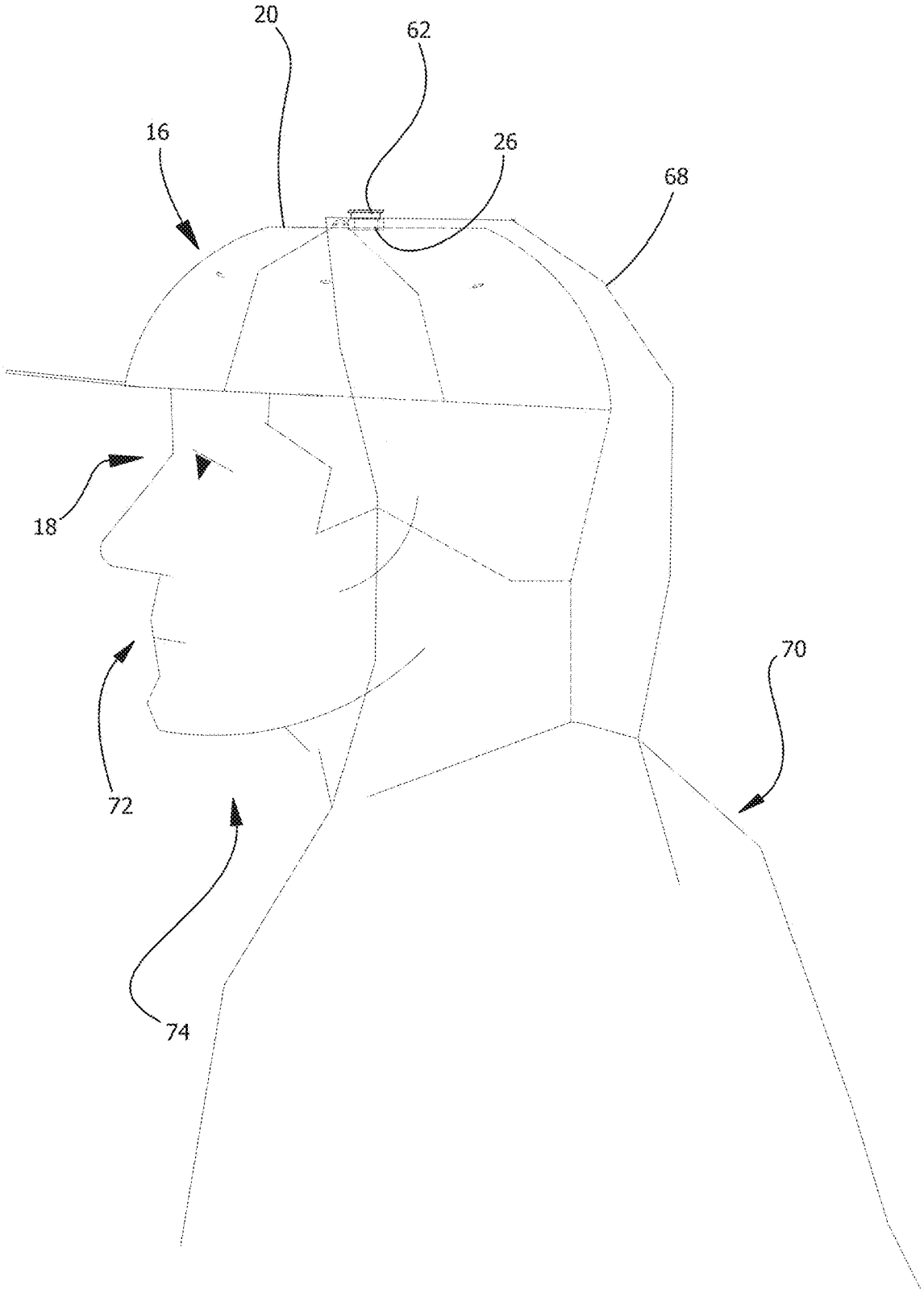
FIG. 5 is a perspective in-use view of an embodiment of the disclosure showing a hood retained on a baseball cap.
Figure 6:
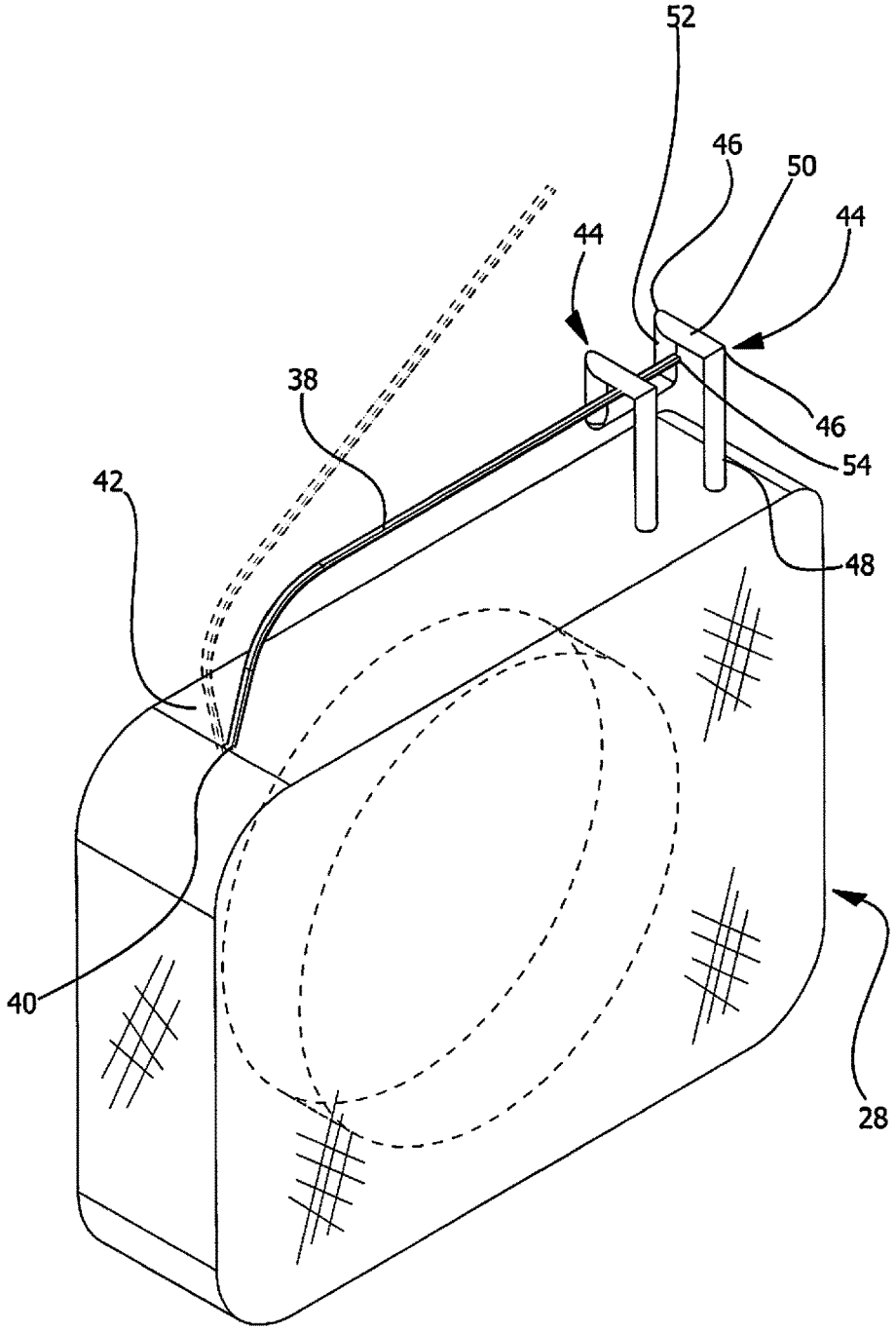
FIG. 6 is a front perspective view of a beanie bag of an embodiment of the disclosure.
Figure 7:
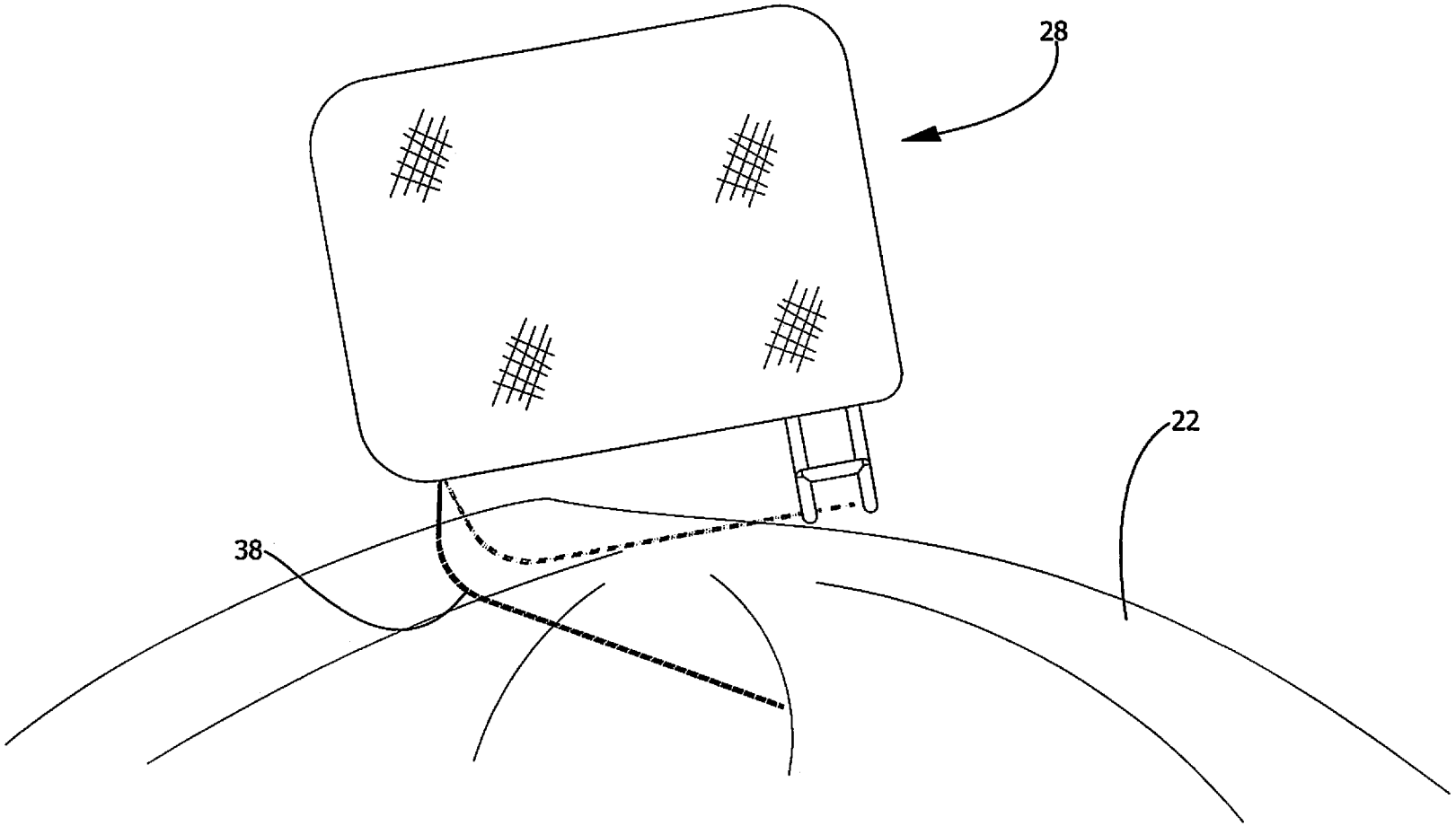
FIG. 7 is a perspective in view of an embodiment of the disclosure showing a beanie bag being attached to a beanie.
Figure 8:
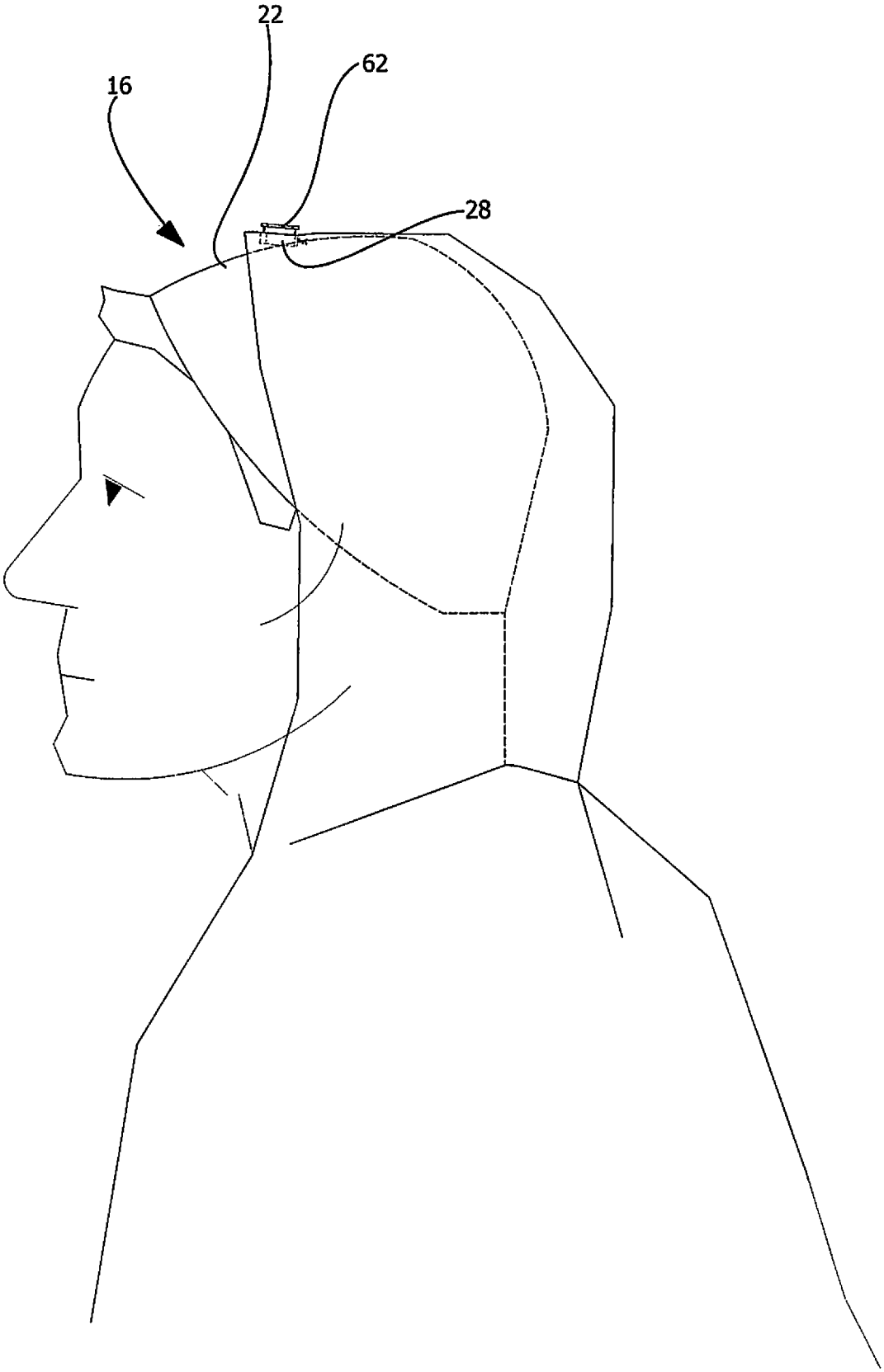
FIG. 8 is a perspective in-use view of an embodiment of the disclosure showing a hood retained on a beanie.
Figure 9:
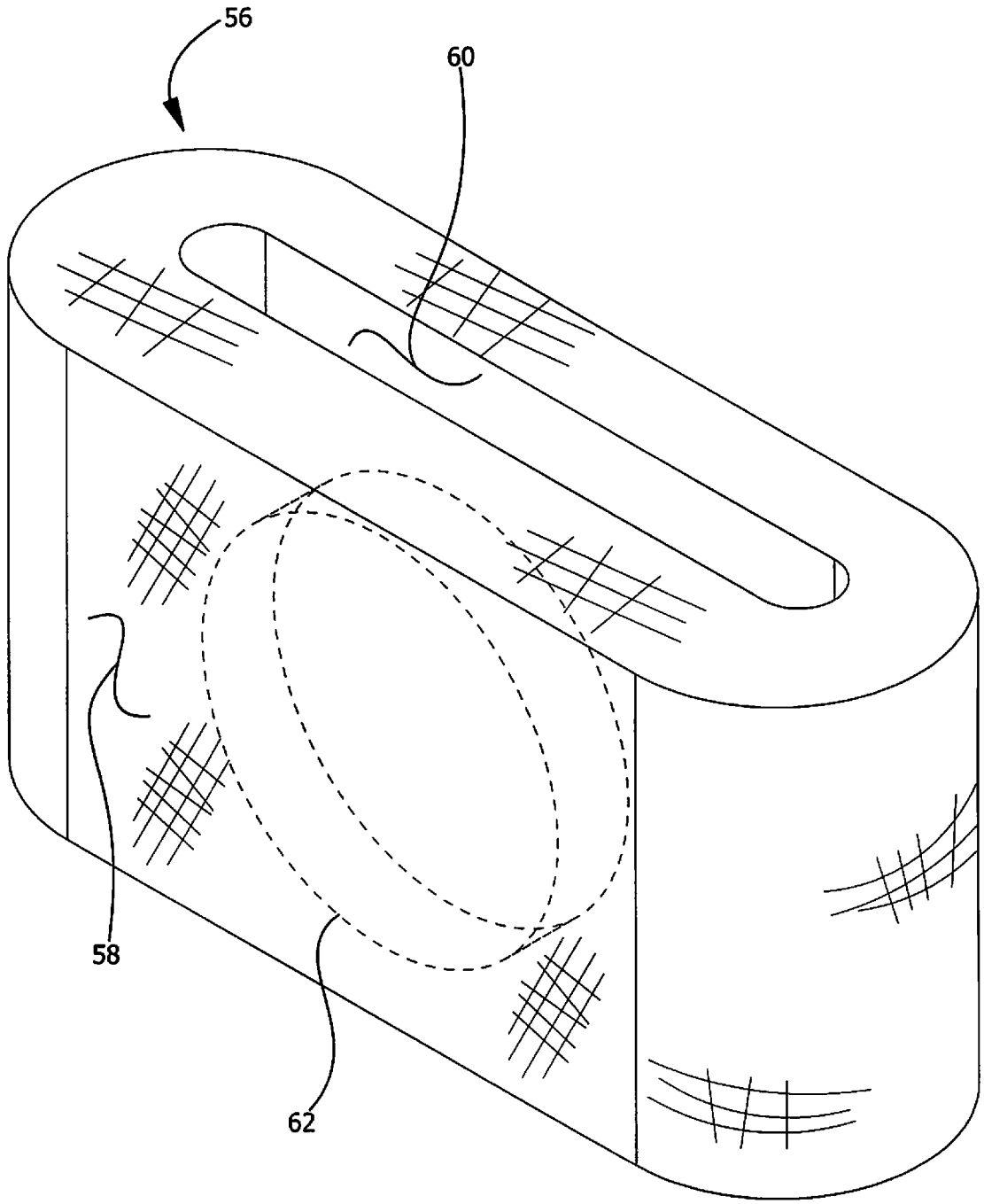
FIG. 9 is a front perspective view of band of an embodiment of the disclosure.
Figure 10:
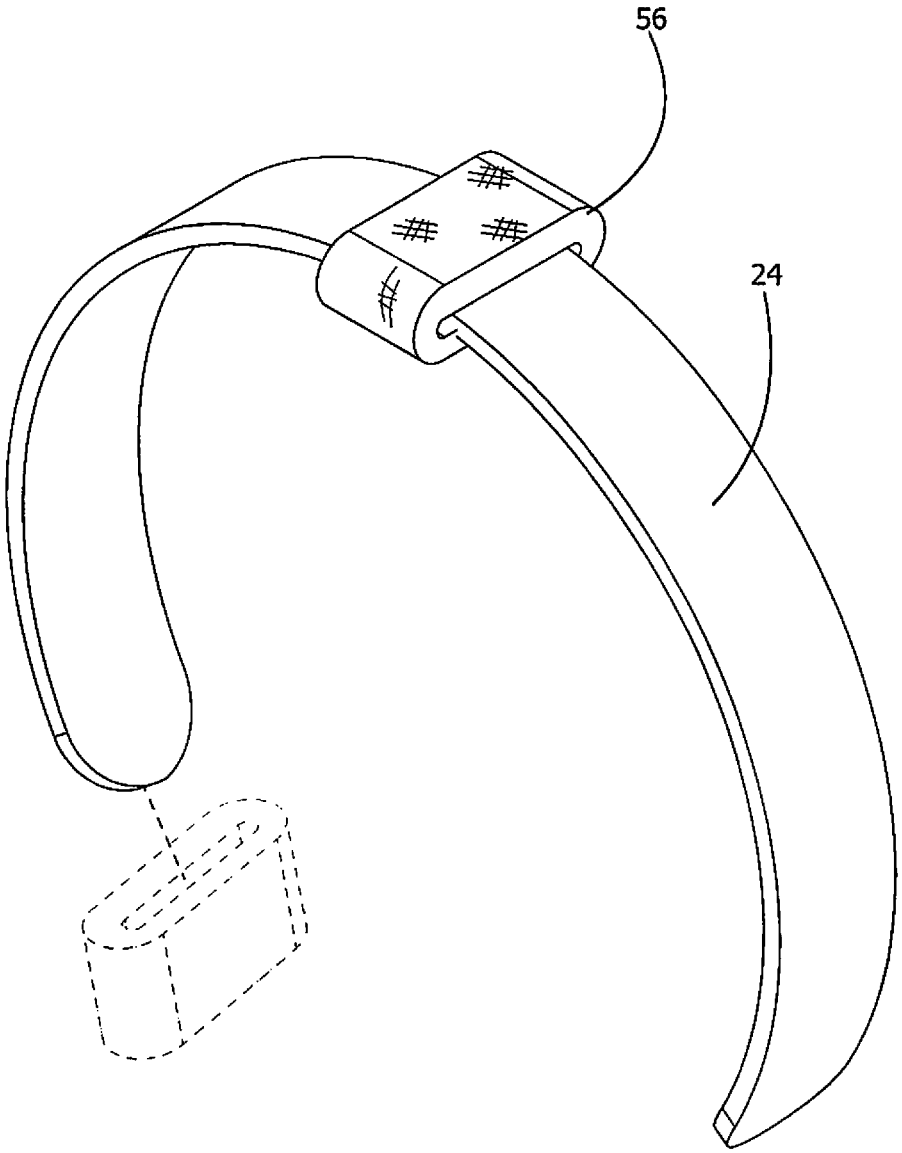
FIG. 10 is a perspective in-use view of an embodiment of the disclosure showing a band being positioned on a headband.
Figure 11:
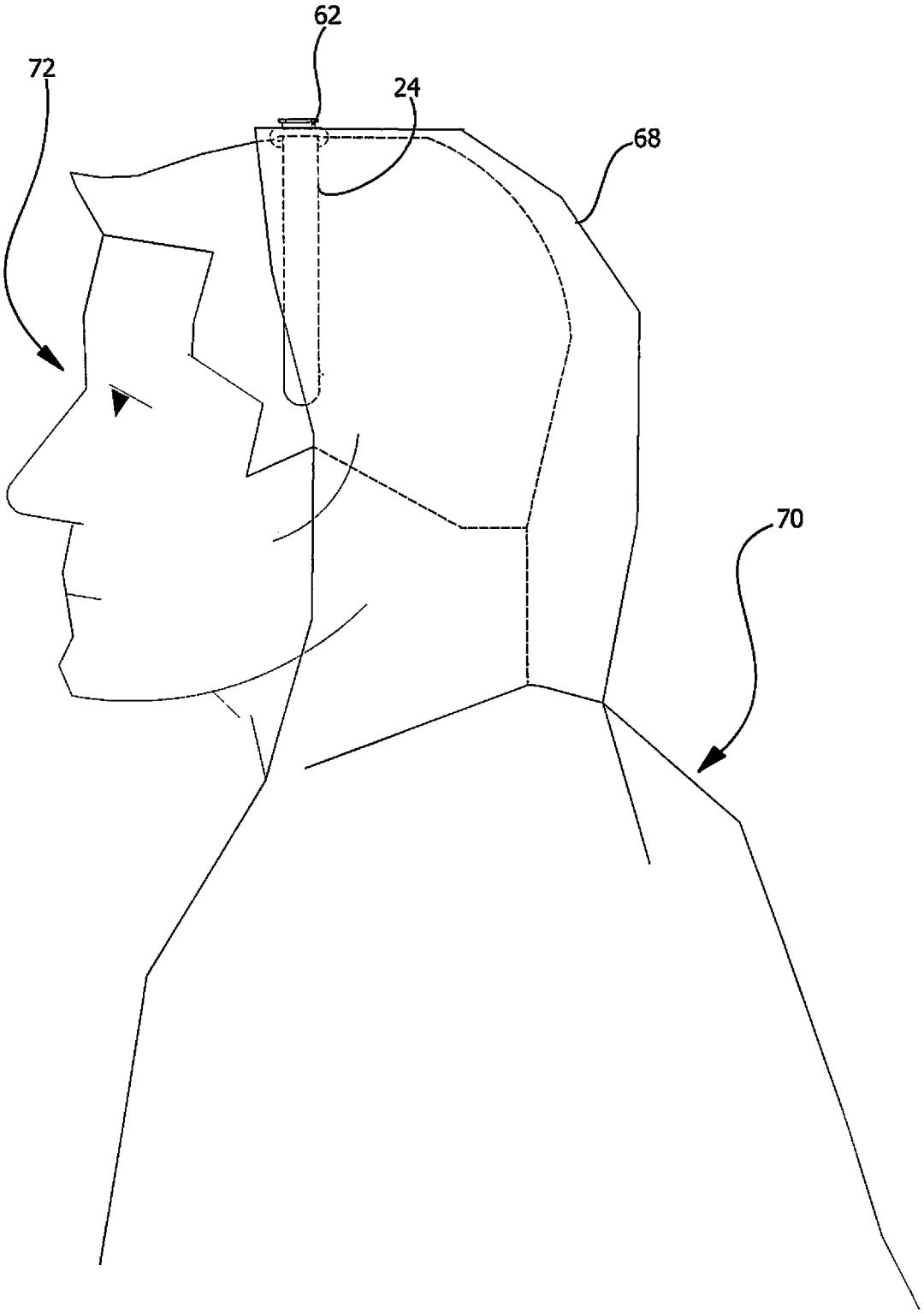
FIG. 11 is a perspective in-use view of an embodiment of the disclosure showing a hood being retained on a headband.
Figure 12:
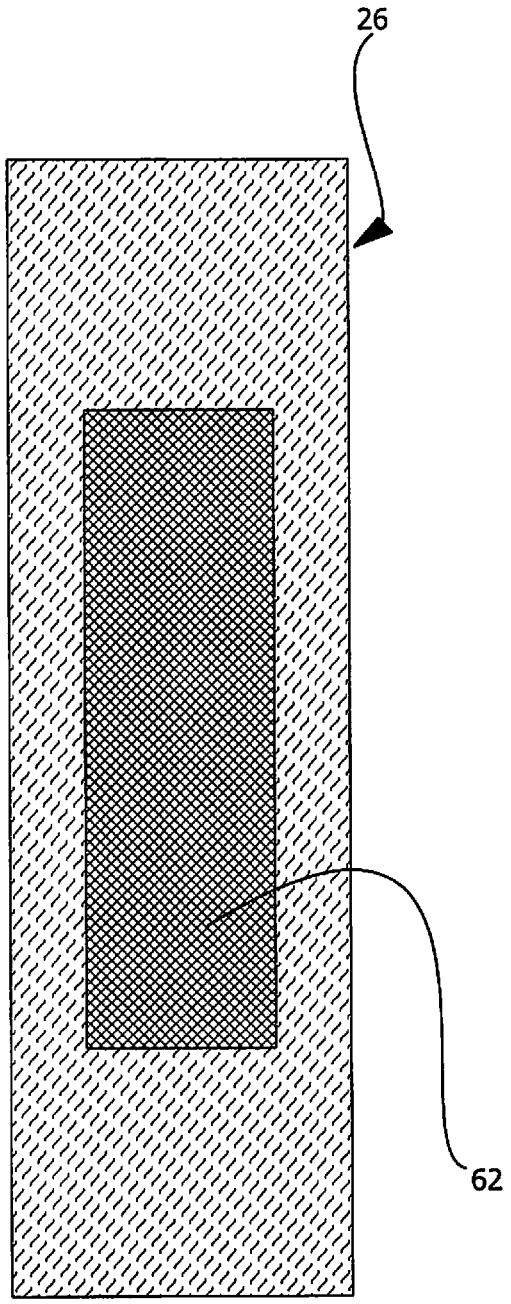
FIG. 12 is a cross sectional view taken along line 12-12 of FIG. 2 of an embodiment of the disclosure.

With reference now to the drawings, and in particular to FIGS. 1 through 12 thereof, a new hood securing device embodying the principles and concepts of an embodiment of the disclosure and generally designated by the reference numeral 10 will be described.

As best illustrated in FIGS. 1 through 12, the hooded sweatshirt securing device 10 generally comprises a plurality of bags 12 that each has a unique engagement element 14 with respect to each other. In this way the engagement element 14 associated with each of the plurality of bags 12 can releasably engage a respective type of article of head wear 16 that is worn on a user's head 18. The article of head gear 16 may include a baseball cap 20, a beanie 22 or a headband 24 and the plurality of bags 12 includes a hat bag 26 and a beanie bag 28. The engagement element 14 associated with the hat bag 26 comprises an annular ring 30 that has an outermost surface 32 which is attached to an upper side 34 of the hat bag 26 such that the annular ring 30 extends away from the upper side 34 of the hat bag 26. Furthermore, the annular ring 30 is comprised of an elastomeric material thereby facilitating the annular ring 30 to be extended around a button 36 located on the baseball cap 20. The hat bag 26 may be comprised of a textile, including but not being limited to, nylon or cotton.

The engagement element 14 associated with the beanie bag 28 comprises a pin 38 that has a coupled end 40 which is coupled to a top side 42 of the beanie bag 28 such that the pin 38 is oriented to extend along the top side 42. In this way the pin 38 can be inserted through a beanie 22 for attaching the beanie bag 28 to the beanie 22. The engagement element 14 associated with the beanie bag 28 includes a pair of members 44 and each of the members 44 is coupled to and extends upwardly from the top side 42 of the beanie bag 28. Each of the members 44 has a series of bends 46 to define a first portion 48 extending upwardly from the top side 42 of the beanie bag 28 and a second portion 50 that is perpendicularly oriented with the first portion 48 and a third portion 52 that is perpendicularly oriented with the second portion 50 such that the third portion 52 of oriented parallel to the first portion 48. The pair of members 44 are spaced apart from each other and each of the pair of members 44 is displaced from the pin 38. In this way a free end 54 of the pin 38 is positionable between the first portion 48 and the third portion 52 of each of the members 44 for retaining the pin 38 to extend along a line that is oriented substantially parallel to the top side 42 of the beanie bag 28. Thus, the pair of members 44 retain the pin 38 in the beanie 22.

A band 56 is provided which is continuous such that the band 56 defines a closed loop. In this way the band 56 can be positioned around a headband 24 that is being worn on the user's head 18. The band 56 has an outwardly facing surface 58 and an inwardly facing surface 60. Additionally, the band 56 may be comprised of a textile, including but not being limited to, nylon or cotton. A plurality of first disks 62 is included and respective ones of the first disks 62 is positioned within a respective one of the plurality of bags 12. Additionally, a respective one of the first disks 62 is integrated into the band 56 and each of the first disks 62 is comprised of a magnetic material. The first disk 62 associated with the band 56 is positioned between the inwardly facing surface 60 and the outwardly facing surface 58 of the band 56.

A coupler 64 is provided that has a coupling element 66 which is releasably matable to a respective one of the plurality of bags 12. In this way the coupler 64 can be positioned on a hood 68 of a hooded sweatshirt 70, or other type of hooded garment, thereby facilitating the coupler 64 to attach the hood 68 to the article of headwear 16 to which the respective bag 12 or band 56 is attached. In this way the hood 68 can be retained in a preferred orientation on the user's head 18. Often times the hood 68 of a hooded sweatshirt 70 partially covers the user's face 72 or the hood 68 of the hooded sweatshirt 70 falls rearwardly from the user's head 18 when the user 74 pulls the hood 68 away from their face 72. The coupler 64 ensures that the hood 68 is retained in a preferred orientation such the hood 68 neither covers the user's face 72 nor falls rearwardly from the user's head 18.

The coupler 64 comprises a panel 76 that has a rearward surface 78 and a forward surface 80 and the panel 76 has indicia 82 is applied to the forward surface 80 comprising an image or a logo. The coupler 64 includes a second disk 84 that has a back side 86 and a front side 88 and the back side 86 is bonded to the lower surface 78 of the panel 76 such that the second disk 84 defines the coupling element 66 of the coupler 64. Furthermore, the second disk 84 is comprised of a magnetic material. The front side 88 of the second disk 84 magnetically engages the first disk 62 of a respective one of the hat bag 26 or the beanie bag 28 or the band 56. In this way the hood 68 is compressed between the second disk 84 and the first disk 62 associated with the respective hat bag 26 or beanie bag 28 or band 56 thereby attaching the hood 68 to the baseball cap 20 or the beanie 22 or the headband 24.

In use, the annular ring 30 is positioned around the button 36 on the baseball cap 20 for attaching the hat bag 26 to the baseball cap 20 and the hood 68 is placed over the baseball cap 20. The coupler 64 is positioned on top of the hood 68 such that the second disk 84 magnetically engages the first disk 62 associated with the hat bag 26. In this way the hood 68 is secured to the baseball cap 20 to retain the hood 68 in a preferred orientation on the user 74. The pin 38 is extended through the beanie 22 and the free end 54 of the pin 38 is positioned between the first portion 48 and the third portion 52 of the pair of members 44 thereby securing the beanie bag 28 to the beanie 22. The hood 68 is placed over the beanie 22 and the coupler 64 is positioned on top of the hood 68 such that the second disk 84 magnetically engages the first disk 62 associated with the beanie bag 28. In this way the hood 68 is secured to the beanie 22 to retain the hood 68 in a preferred orientation on the user 74. The headband 24 is slipped through the band 56 such that the first disk 62 associated with the band 56 is directed upwardly from the headband 24. The hood 68 is placed over the headband 24 and the coupler 64 is positioned on top of the hood 68 such that the second disk 84 magnetically engages the first disk 62 associated with the band 56. In this way the hood 68 is secured to the headband 24 to retain the hood 68 in a preferred orientation on the user 74.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hooded sweatshirt securing device for securing a hood of a hooded sweatshirt to an article of headwear for retaining the hood in a preferred orientation on a user's head, said device comprising:

a plurality of bags, each of said plurality of bags having a unique engagement element with respect to each other wherein said engagement element associated with each of said plurality of bags is configured to releasably engage a respective type of article of head wear being worn on a user's head;

a band being continuous such that said band defines a closed loop wherein said band is configured to be positioned around a headband being worn on the user's head;

a plurality of first disks, respective ones of said first disks being positioned within a respective one of said plurality of bags, a respective one of said first disks being integrated into said band, each of said first disks being comprised of a magnetic material;

a coupler having a coupling element which is releasably matable to a respective one of said plurality of bags wherein said coupler is configured to be positioned on a hood of a hooded sweatshirt thereby facilitating said coupler to attach the hood to the article of headwear to which said respective receiver is attached thereby retaining the hood in a preferred orientation on the user's head; and wherein said plurality of bags includes a beanie bag, said engagement element associated with said beanie bag comprises a pin having a coupled end being coupled to a top side of said beanie bag such that said pin is oriented to extend along said top side wherein said pin is configured to be inserted through a beanie for attaching said beanie bag to the beanie, and a pair of members, each of said members being coupled to and extending upwardly from said to side of said beanie bag, each of said members having a series of bends to define a first portion extending upwardly from said to side of said beanie bag and a second portion being perpendicularly oriented with said first portion and a third portion being perpendicularly oriented with said second portion such that said third portion is oriented parallel to said first portion.

2. The device according to claim 1, wherein said plurality of bags includes a hat bag, said engagement element associated with said hat bag comprising an annular ring having an outermost surface being attached to an upper side of said hat bag such that said annular ring extends away from said upper side of said hat bag, said annular ring being comprised of an elastomeric material wherein said annular ring is configured to be extended around a button located on a baseball cap.

3. The device according to claim 1, wherein:

said pair of members is spaced apart from each other;

each of said pair of members is displaced from said pin such that a free end of said pin is positionable between said first portion and said third portion of each of said members for retaining said pin to extend along a line being oriented substantially parallel to said top side of said beanie bag wherein said pair of members is configured to retain said pin in the beanie.

4. The device according to claim 1, wherein:

said band has an outwardly facing surface and an inwardly facing surface; and said first disk associated with said band being positioned between said inwardly facing surface and said outwardly facing surface of said band.

5. The device according to claim 1, wherein said coupler comprises:

a panel having a lower surface and a forward surface, said panel having indicia being applied to said forward surface comprising an image or a logo;

a second disk having a back side and a front side, said back side being bonded to said lower surface of said panel such that said second disk defines said coupling element of said coupler, said second disk being comprised of a magnetic material; and said second disk magnetically engages said first disk of a respective one of said hat bag, said beanie bag, and said band wherein said second disk is configured to compress the hood between said second disk and said first disk associated with said respective hat bag or beanie bag or band thereby attaching the hood to the baseball cap or the beanie or the headband.

6. A hooded sweatshirt securing device for securing a hood of a hooded sweatshirt to an article of headwear for retaining the hood in a preferred orientation on a user's head, said device comprising:

a plurality of bags, each of said plurality of bags having a unique engagement element with respect to each other wherein said engagement element associated with each of said plurality of bags is configured to releasably engage a respective type of article of head wear being worn on a user's head, said plurality of bags including a hat bag and a beanie bag, said engagement element associated with said hat bag comprising an annular ring having an outermost surface being attached to an upper side of said hat bag such that said annular ring extends away from said upper side of said hat bag, said annular ring being comprised of an elastomeric material wherein said annular ring is configured to be extended around a button located on a baseball cap, said engagement element associated with said beanie bag comprising:

a pin having a coupled end being coupled to a top side of said beanie bag such that said pin is oriented to extend along said top side wherein said pin is configured to be inserted through a beanie for attaching said beanie bag to the beanie; and a pair of members, each of said members being coupled to and extending upwardly from said top side of said beanie bag, each of said members having a series of bends to define a first portion extending upwardly from said top side of said beanie bag and a second portion being perpendicularly oriented with said first portion and a third portion being perpendicularly oriented with said second portion such that said third portion is oriented parallel to said first portion, said pair of members being spaced apart from each other, each of said pair of members being displaced from said pin such that a free end of said pin is positionable between said first portion and said third portion of each of said members for retaining said pin to extend along a line being oriented substantially parallel to said top side of said beanie bag wherein said pair of members is configured to retain said pin in the beanie;

a band being continuous such that said band defines a closed loop wherein said band is configured to be positioned around a headband being worn on the user's head, said band having an outwardly facing surface and an inwardly facing surface;

a plurality of first disks, respective ones of said first disks being positioned within a respective one of said plurality of bags, a respective one of said first disks being integrated into said band, each of said first disks being comprised of a magnetic material, said first disk associated with said band being positioned between said inwardly facing surface and said outwardly facing surface of said band;

a coupler having a coupling element which is releasably matable to a respective one of said plurality of bags wherein said coupler is configured to be positioned on a hood of a hooded sweatshirt thereby facilitating said coupler to attach the hood to the article of headwear to which said respective receiver is attached thereby retaining the hood in a preferred orientation on the user's head, said coupler comprising:

a panel having a lower surface and a forward surface, said panel having indicia being applied to said forward surface comprising an image or a logo; and a second disk having a back side and a front side, said back side being bonded to said lower surface of said panel such that said second disk defines said coupling element of said coupler, said second disk being comprised of a magnetic material, said second disk magnetically engaging said first disk of a respective one of said hat bag or said beanie bag or said band wherein said second disk is configured to compress the hood between said second disk and said first disk associated with said respective hat bag or beanie bag or band thereby attaching the hood to the baseball cap or the beanie or the headband.

* * * * *